US007121226B2

(12) United States Patent
Grimaldi

(10) Patent No.: US 7,121,226 B2
(45) Date of Patent: Oct. 17, 2006

(54) MOVABLE PLATFORM UNIT FOR A BOAT PARTICULARLY FOR HAULING AND LAUNCHING TENDERS AND THE LIKE

(75) Inventor: Michele Grimaldi, Piossasco (IT)

(73) Assignee: Opacmare S.p.A., Rivalta (IT)

( * ) Notice: Subject to any disclaimer, the term of this patent is extended or adjusted under 35 U.S.C. 154(b) by 0 days.

(21) Appl. No.: 10/518,046

(22) PCT Filed: Jun. 18, 2002

(86) PCT No.: PCT/IT02/00401

§ 371 (c)(1),
(2), (4) Date: Dec. 16, 2004

(87) PCT Pub. No.: WO03/106254

PCT Pub. Date: Dec. 24, 2003

(65) Prior Publication Data

US 2006/0075952 A1 Apr. 13, 2006

(51) Int. Cl.
*B63B 17/00* (2006.01)

(52) U.S. Cl. ..... 114/362; 14/69.5; 182/84

(58) Field of Classification Search ..... 114/44, 114/230.1, 249, 258, 362; 14/69.5, 71.1, 14/71.7; 182/1, 84, 86; 405/218, 219, 220
See application file for complete search history.

(56) References Cited

U.S. PATENT DOCUMENTS 1,215,827 A * 2/1917 Lord ..... 182/1
4,293,967 A 10/1981 Ord
4,971,168 A 11/1990 Stanescu
5,794,292 A 8/1998 Ricci, Jr.
5,950,267 A * 9/1999 Ricci, Jr. ..... 14/71.1
6,182,598 B1 * 2/2001 Bozzo ..... 114/362

FOREIGN PATENT DOCUMENTS

DE 201 17 693 U 2/2002

* cited by examiner

*Primary Examiner*—Lars A. Olson
(74) *Attorney, Agent, or Firm*—Sughrue Mion, PLLC

(57) ABSTRACT

A movable platform unit (1) for a boat (B), in particular for launching or hauling out a tender or the like, includes a base portion (2) secured to the boat (B) and at least one swing arm (32*a*, 32*b*), pivoted at one end onto the base portion (2) and at the other to a load platform (3). The swing arm (32*a*, 32*b*) can be rotated by a first drive member (57) secured thereto and rotatable about the axis (x) about which the swing arm (32*a*, 32*b*) is pivoted on the base portion (2). Alignment means (67, 68) are provided for connecting the load platform (3) to a second drive member (65*a*) secured to the base portion (2) and coaxial with the axis (x) about which the swing arm (32*a*, 32*b*) is pivoted on the base portion (2) so as to enable the platform (3) to maintain a constant inclination to the base portion (2) during rotation of the swing arms (32*a*, 32*b*)

7 Claims, 6 Drawing Sheets

MOVABLE PLATFORM UNIT FOR A BOAT PARTICULARLY FOR HAULING AND LAUNCHING TENDERS AND THE LIKE

The present invention relates to a movable platform unit for a boat, intended in particular for launching or hauling out a tender or similar water craft, of the type described in the preamble to Claim 1.

It is known that certain categories of vessels, such as yachts, use small cranes, generally positioned in the stern, for lowering into the water or hauling out small tenders.

The use of movable platforms, which can be lowered beneath the surface of the water for launching a tender, is also known in the art. German patent DE 19 963 057 and German utility model DE 29 922 612, for example, describe a platform unit of the type referred to above. This platform unit has a plurality of arms which move in pantograph style, giving the platform enough range of movement that it can also be used as a gangway for passengers to move from one vessel to another.

The versatility of this known platform unit is fairly limited however: the range of movement which can be achieved only enables the platform to reach a landing stage or boat deck having heights which are not much different from that of the vessel on which it is installed. In addition, the platform cannot be retracted, meaning that is always on view even when not in use. This is a disadvantage from an aesthetic point of view, especially in the case of a yacht, wherein such an aspect is often of great importance.

These problems are overcome according to the invention by providing a platform unit having the characteristics claimed in Claim 1.

Preferred embodiments of the invention are described in the dependent Claims.

In particular, in some of these embodiments, the platform unit has automatically adjustable steps, which provide easy access to and from the vessel, whatever the height of the movable platform. The platform unit of the invention can therefore also be used as a ladder for swimmers to get in and out of the water.

These and other objects will become more apparent from the detailed description of a preferred, but non-limitative embodiment of the invention, provided with reference to the appended drawings, in which.

Figure 1:
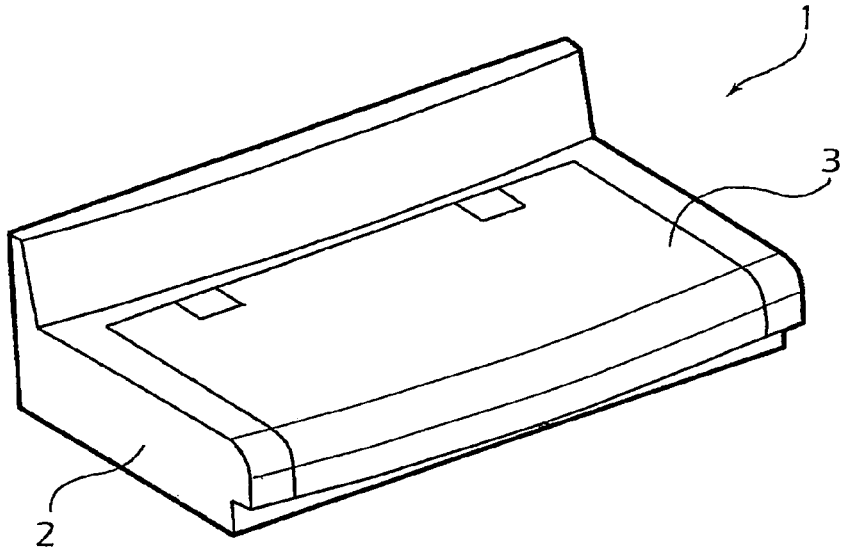
FIG. 1 is a perspective view of a platform unit for a vessel according to the present invention, shown in a first operating position.

With reference to FIG. 1, a platform unit 1 according to the invention is shown, which is intended to be mounted preferably in the stern portion of a vessel. The platform unit 1 includes a base 2, with a movable platform 3 pivoted thereon and shown in a closed position in FIG. 1. The base 2 can have means (not shown) for enabling the unit 1 to be fixed to the structure of the vessel or, in an alternative embodiment, can be incorporated into the structure of the vessel.

Figure 2:
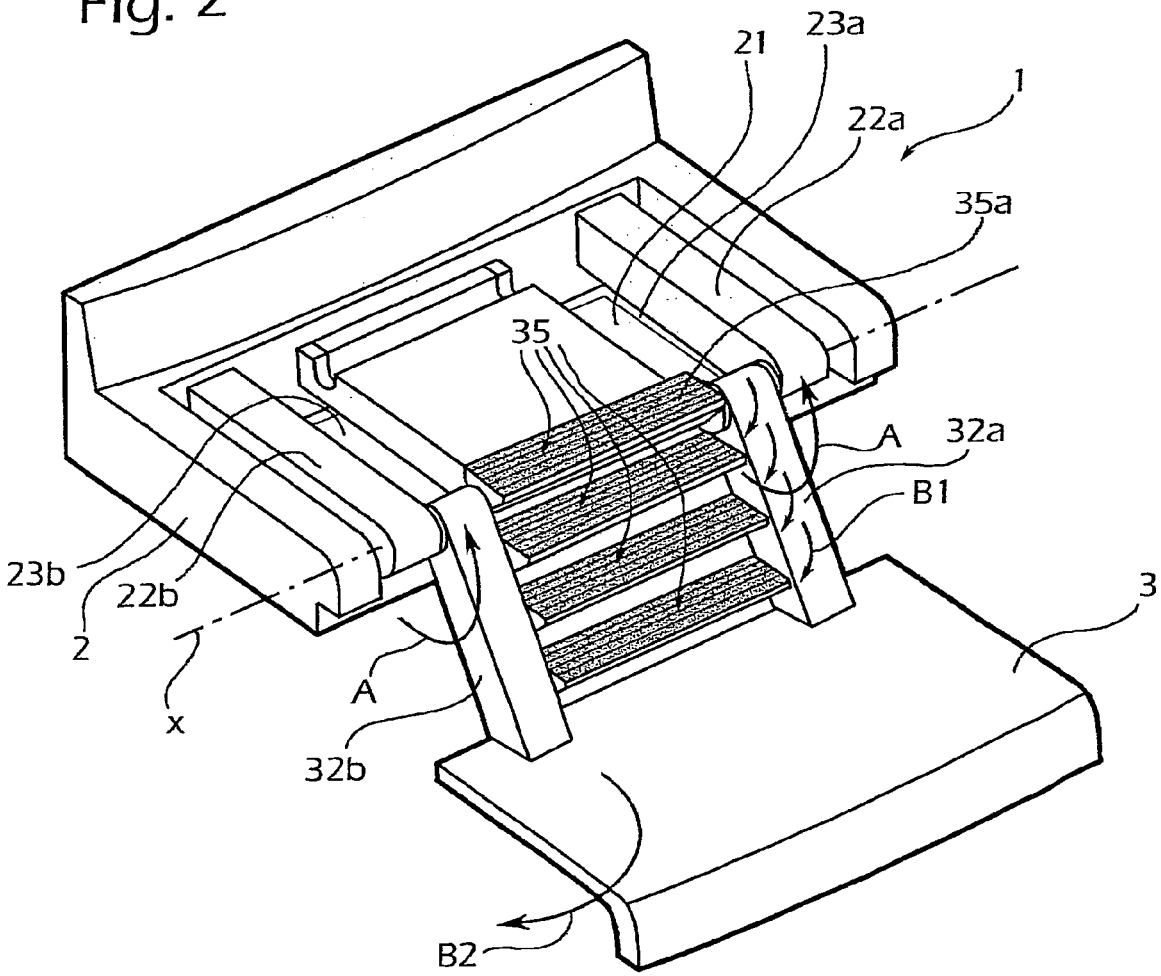
FIG. 2 is a perspective view of the platform unit of FIG. 1 in a second operating position.

With reference to FIG. 2, the platform unit 1 is shown in its fully extended position. The base 2 of this unit has a cavity 21 for housing the movable platform 3. The cavity 21 is shaped so that, in its closed position, the platform 3 precisely fits the overall shape of the base 2, as illustrated in FIG. 1. The cavity 21 also houses a pair of fixed arms 22*a*, 22*b*.

Figure 3:
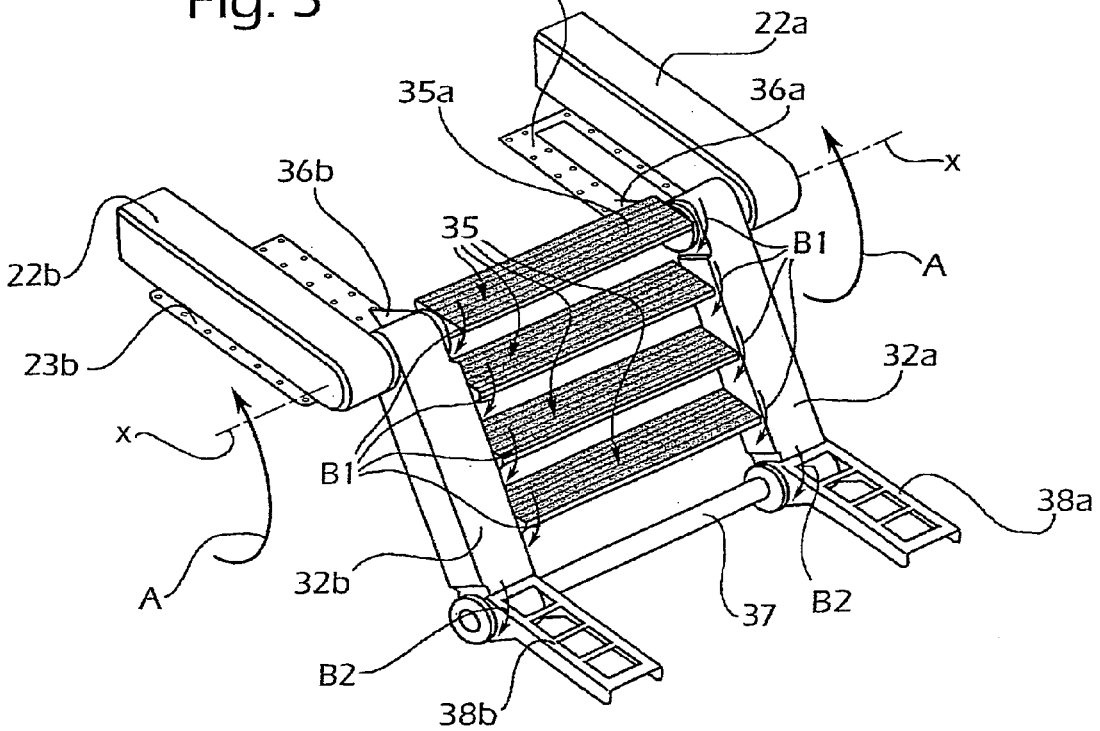
FIG. 3 is a perspective view of a structure of the platform unit of FIG. 1 in the second operating assembly.

As can be seen better in FIG. 3, the fixed arms 22*a*, 22*b* have respective fixing plates 23*a*, 23*b* for mounting them on the base 2 by conventional fixing means, such as bolts, for example. Swing arms 32*a*, 32*b* are connected to the distal ends of the fixed arms 22*a*, 22*b*, respectively, so that they can turn in a vertical plane, perpendicular to the overall plane of the base 2 of the platform unit 1 (each in the direction indicated by the arrow A). The swing arms 32*a*, 32*b* and a plurality of steps 35 connected thereto form a ladder, which is orientable in a vertical plane. Each step 35 is turnable about its own longitudinal axis relative to the swing arms 32*a*, 32*b* (in the direction shown by the arrows B1). The top step 35*a* is secured to the base 2 of the platform unit 1 by a pair of brackets 36*a*, 36*b* fixed by one end to the ends of the step 35*a* and by the other to the base 2 itself.

Figure 4:
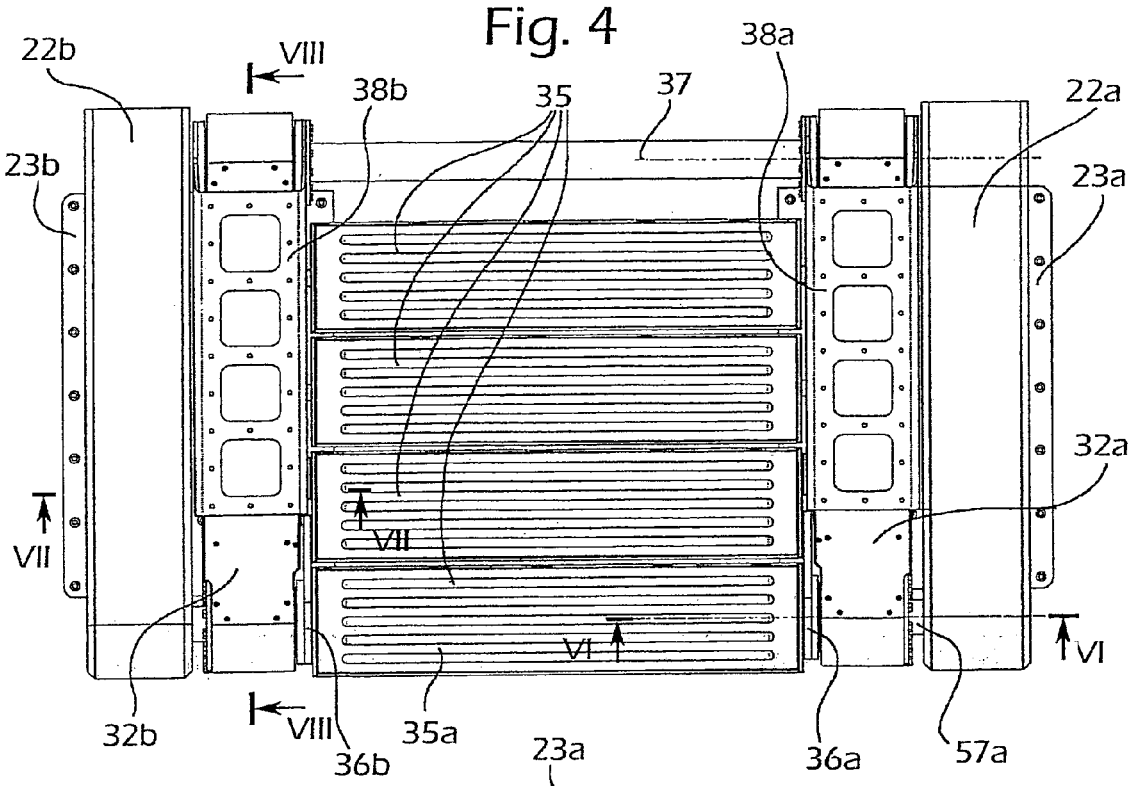
FIG. 4 is a plan view from above of the structure of FIG. 3 in the first operating position.

The distal ends of the swing arms 32*a*, 32*b* are finally connected by a cross member 37, also turnable about its longitudinal axis relative to the swing arms 32*a*, 32*b* (in the directions indicated by the arrows B2). A pair of supports 38*a*, 38*b* is fixed one to each end of the cross member 37, being thus pivoted on the swing arm 32*a*, 32*b*. It can be seen that the supports 38*a*, 38*b* are able to turn in a vertical plane relative to the swing arms 32*a*, 32*b* (in the sense indicated by the arrows B2) until they reach the closed position shown in FIG. 4, folded along the arms 32*a*, 32*b*. The supports 38*a*, 38*b* are provided for mounting the movable platform 3, as shown in FIG. 2.

Figure 5:
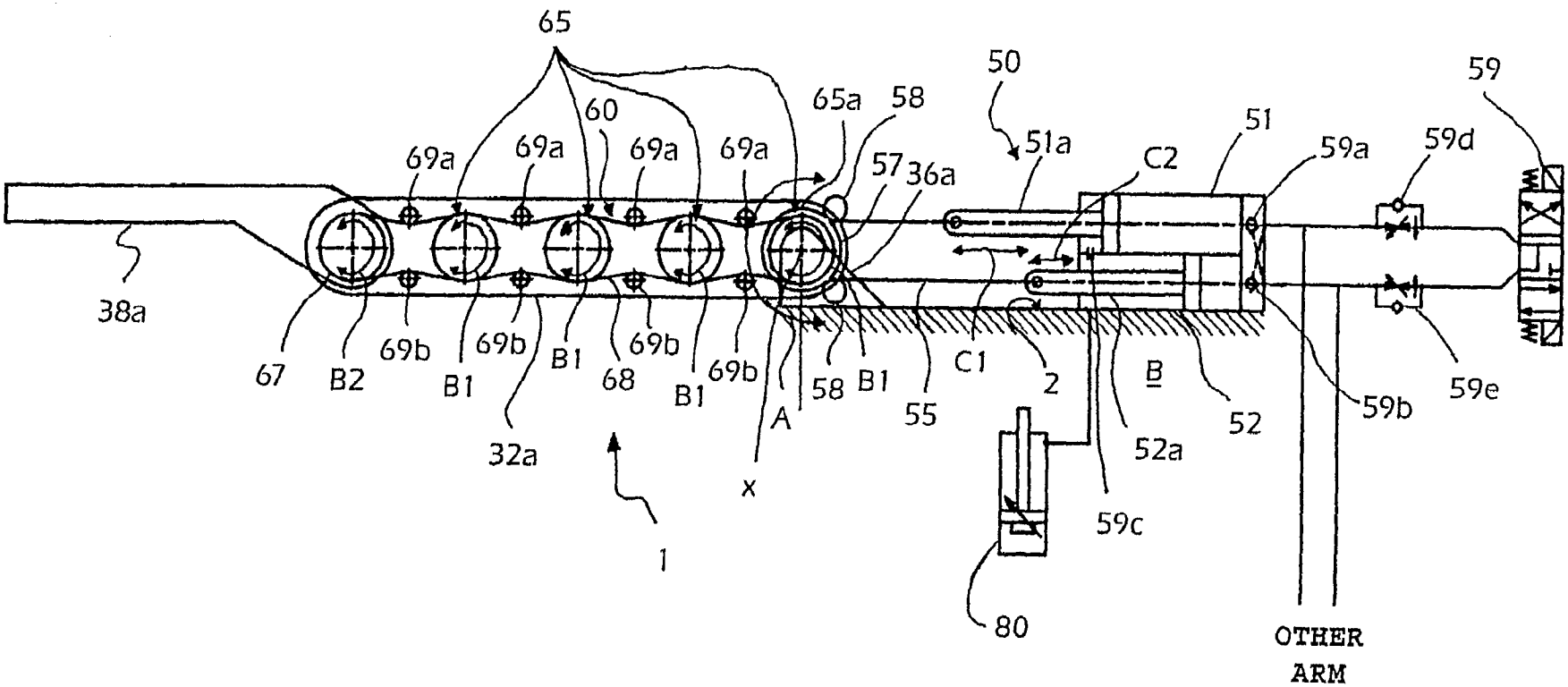
FIG. 5 is a schematic side elevation view of a platform unit according to the present invention.

The diagram shown in FIG. 5 better illustrates the operation of the platform unit of the invention. This diagram consists of a side view of the platform unit 1 mounted on a boat, generally indicated B. An operating unit 50 includes a pair of single-acting hydraulic cylinders 51, 52, having respective rods 51*a*, 52*a* (slidable in the direction indicated by the arrows C1 and C2 respectively) secured to the end of a drive chain 55. The drive chain 55 passes over an operating pulley 57. As can be seen better from FIG. 6, this pulley 57 is keyed onto a shaft 57*a* which is secured to the swing arm 32*a*. The pulley 57 and the swing arm 32*a* to which it is attached are pivoted on the bracket 36*a* so as to be able to turn about the axis x of the pulley 57 (along the arrows A). In order to increase the angle over which the chain 55 contacts the pulley 57 and to avoid non-axial stress on the cylinder rods, chain guides 58 are provided, shown in FIG. 5.

The operating unit 50, controlled by a hydraulic control unit which includes a solenoid control valve 59, is at least partly enclosed within the fixed arm 22*a* (see FIG. 2 by way of example), which is hollow for this purpose. The swing arm 32*b* naturally also has an operating unit, identical to that described above and controlled by the same control unit. The solenoid control valve 59 is connected separately to the cylinders 51, 52 through respective piloted unidirectional valves 59*a*, 59*b*, and is operable to control selectively either the upper cylinders 51 or the lower 52. Inserted into the bottom of the cylinders 51, 52, the piloted non-return valves 59*a*, 59*b*, selectively block flow of the hydraulic fluid, enabling the platform 3 to be locked into any position.

The rod-side chambers of the upper cylinders 51 and those of the lower cylinders 52 are in communication by means of a passage 59*c*, the function of which will be described later, Unidirectional flow-regulator valves 59*d* and 59*e* connect the solenoid valve 59 with the non-return valve 59*a* and the non-return valve 59*b* respectively.

The platform unit of the invention makes it possible to turn the swing arms 32*a*, 32*b* through a maximum angle of around 240° or even more from the closed position, in which the said arms 32*a*, 32*b* are lying flat on the base 2 of the platform unit 1, to the fully open position dependent on the particular arrangement of the axis x about which the arms 32*a*, 32*b* are pivoted.

Figure 6:
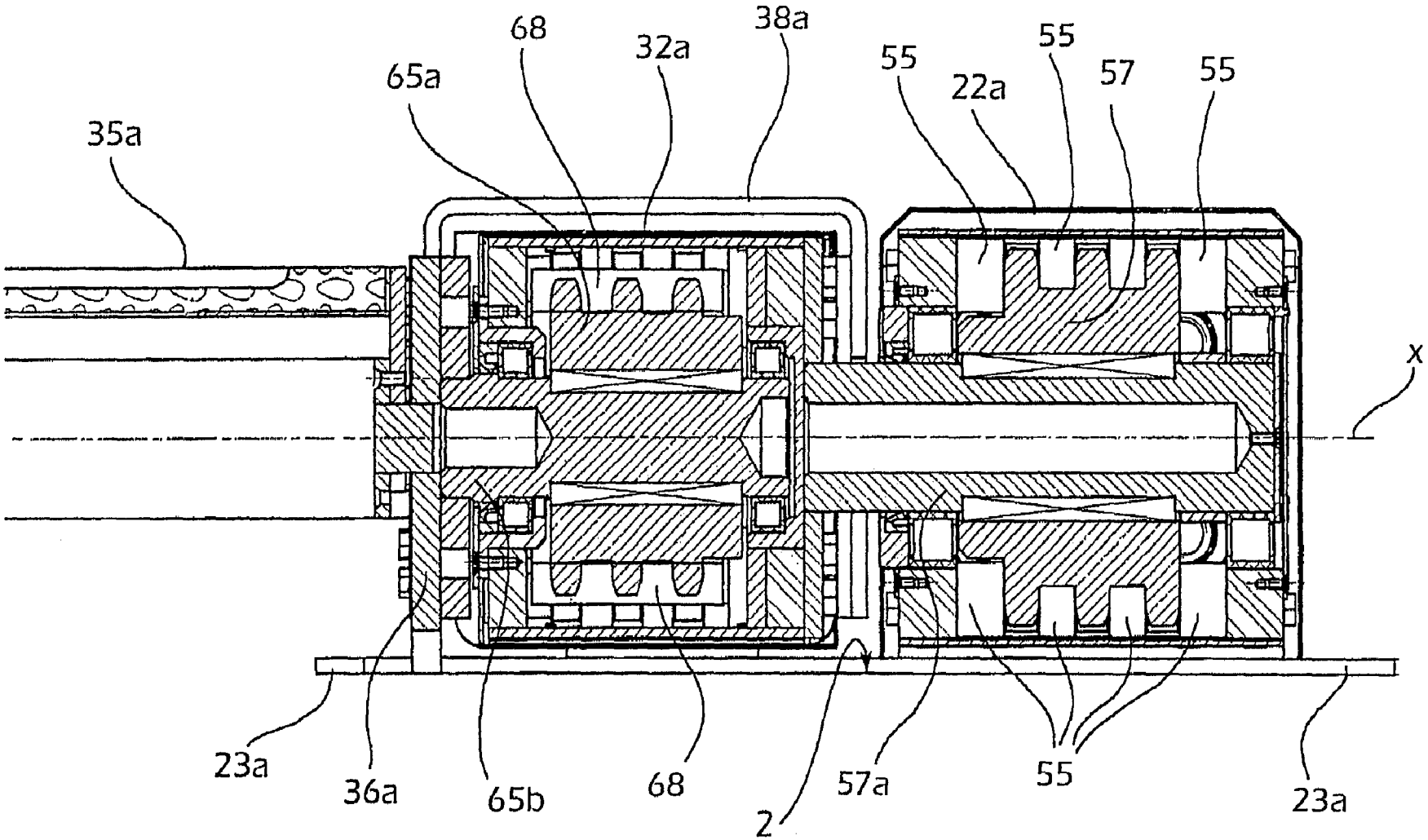
FIG. 6 is a sectioned view of the structure of FIG. 4 taken on the line VI—VI of this Figure.
Figure 7:
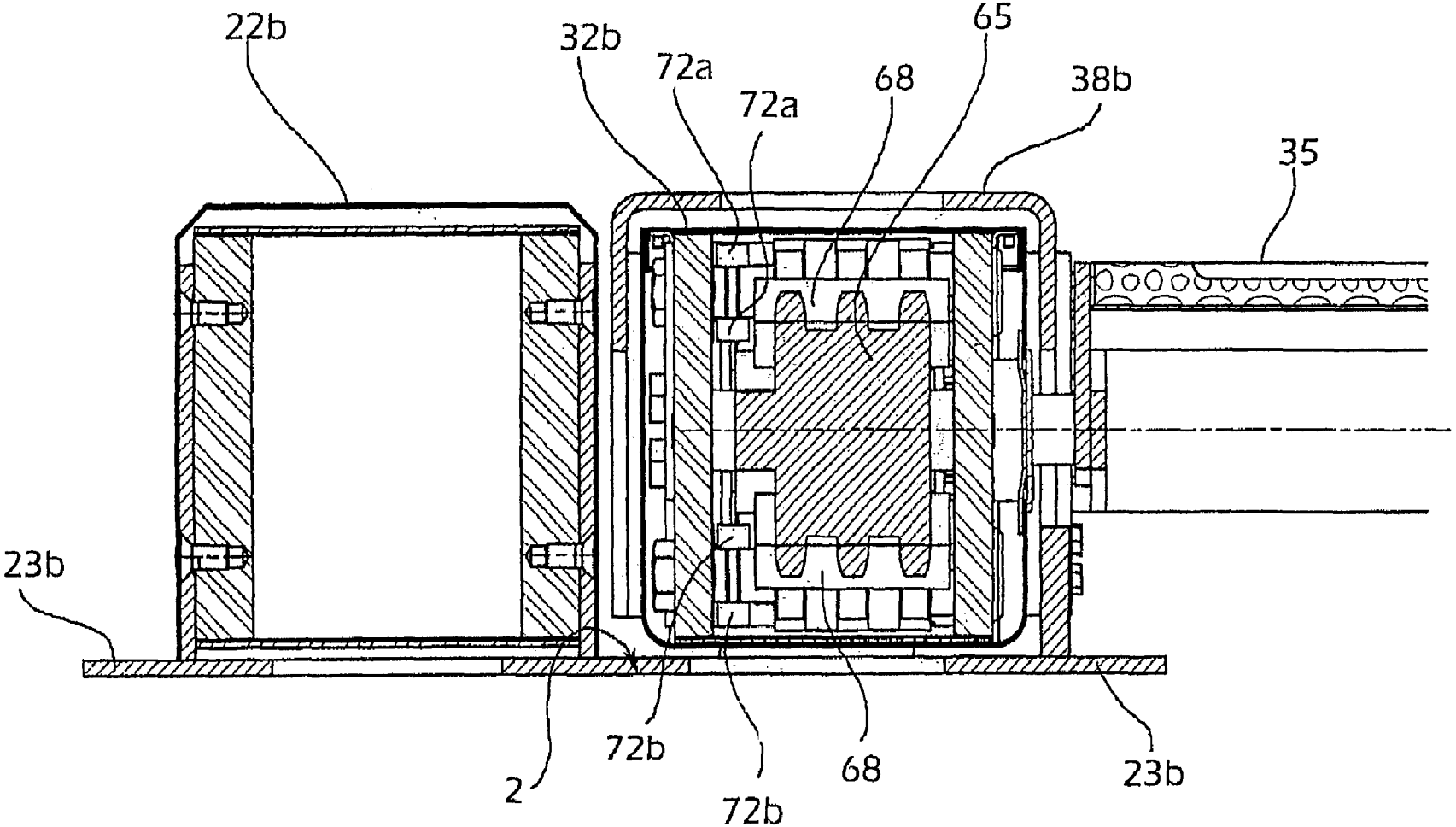
FIG. 7 is a sectioned view of the structure of FIG. 4 taken on the line VII—VII of this Figure.
Figure 8:
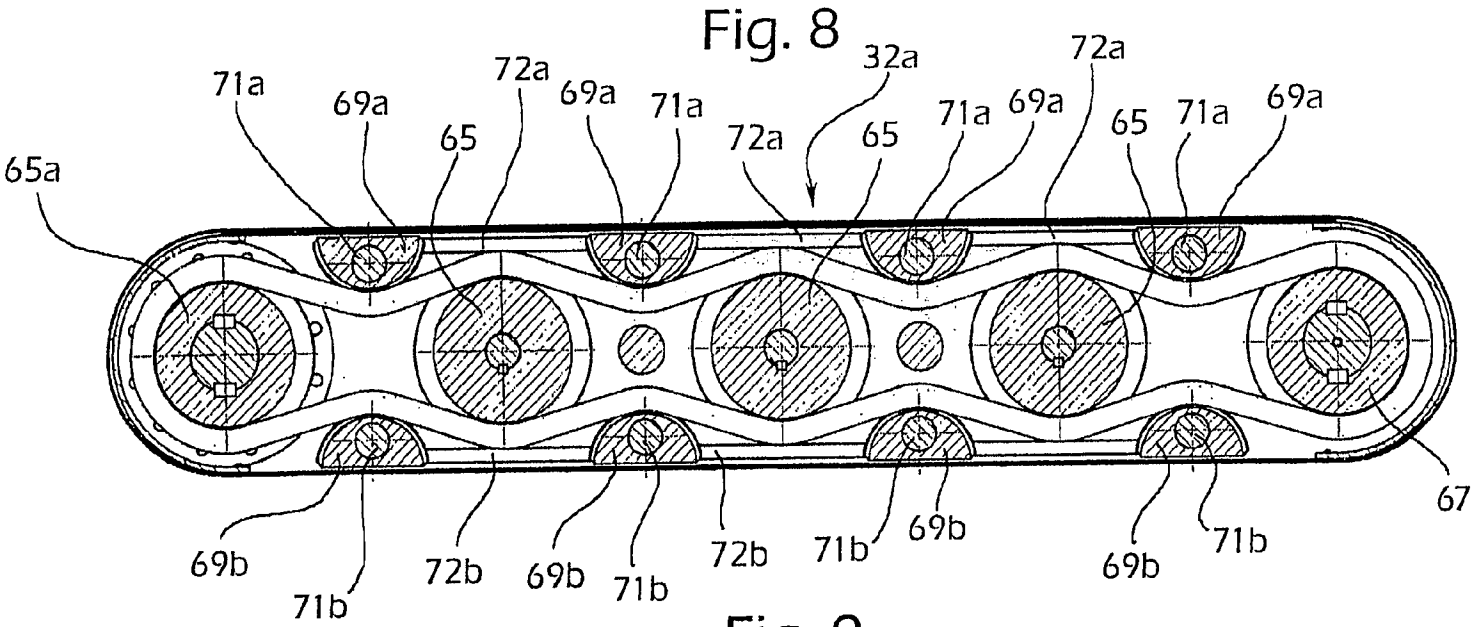
FIG. 8 is a sectioned view of the structure of FIG. 4 taken on the line VIII—VIII of this Figure.

The swing arm 32*a*, which is also hollow, contains an alignment unit 60 for ensuring that the steps 35 and the platform 3 retain their orientation relative to the base 2 during rotation of the swing arms 32*a*. To this end, each step 35 (as shown in FIG. 7) is secured to a respective pulley 65, by means of the shaft onto which each pulley 65 is keyed. The shaft of each pulley 65 passes through the inward sidewall of the swing arm 32*a*. This means that the pulley 65 and its associated step 35 are pivoted on the swing arm 32*a*, so as to be rotatable about an axis parallel to the axis x. With reference to FIG. 6, the step 35*a* is secured to the respective pulley 65*a* by means of the shaft 65*b* onto which this pulley 65*a* is keyed. The shaft 65*b* of the pulley 65*a* passes through the inward side wall of the swing arm 32*a*, coaxially with, but independently of the shaft 57*a* of the pulley 57 and is secured to the bracket 36*a*, thus ensuring that it remains immobile during rotation of the swing arm 32*a*. A final pulley 67, similar to the aforementioned pulleys 65 and 65*a*, is secured to the cross-member 37 (shown in FIG. 3). With reference to FIGS. 5 and 8, an alignment chain 68 passes over the pulleys 65, 65*a* and 67 so as to ensure that the pulleys all rotate in unison.

With reference to FIG. 8, in which only the swing arm 32*a* has been shown for the sake of simplicity, upper and lower tensioner devices 69*a*, 69*b* make it possible to increase the contact angle of the chain 68 over the pulleys 65, 65*a*, 67 and thereby to keep tension constant. The tensioner devices 69*a*, 69*b* preferably consist of a plurality of rollers carried on corresponding adjustable eccentric pins 71*a*. The eccentric pins 71*a* associated with the upper tensioner devices 69*a* are connected to each other by a chain 72*a* which ensures that the position of the platform 3 and the steps 35 is adjusted evenly, by applying the same deformation to each free portion of the alignment chain 68. The lower tensioner devices 69*b* are also connected by a chain 72*b*, in an arrangement which is the same as that just described and so will not be described here.

With reference to FIG. 5, operation of the platform unit of the invention when in its initial, closed position will now be described. An operator causes the hydraulic control unit to introduce fluid through the bottom of the upper cylinders 51. The oil contained in the rod-side chambers of the upper cylinders 51, flows through the passage 59*c* and into the rod-side chambers of the lower cylinders 52. The rods 52*a* slide in the cylinders 52, drawing along the lower branch of the chain 55 and thereby causing the pulley 57 to rotate. As a result, the swing arms 32*a*, 32*b* rotate, moving upwards and away from the closed position. Once the swing arms 32*a*, 32*b* have reached a vertical position, this movement is controlled by the one-way flow-regulator valve 59*e*, arranged in the hydraulic unit, which provides sufficient counter-pressure on the hydraulic return duct to exert a braking action on the platform 3, which is descending on the supports 38*a* under the weight of the structure and of any load carried on the platform 3. An additional one-way flow regulator 59*d* is arranged on the other branch of the hydraulic supply system and carries out the same function of descent controlling, when the movement is in the opposite direction, that is when the platform is being returned to its closed condition.

As described above, the rod-side chambers of the upper cylinders 51 and lower cylinders 52 are in free communication with each other, and connectable to an external control unit by means of respective connectors fitted with unidirectional valves 59*a*, 59*b*: by introducing pressurized fluid through these valves, it is possible to compensate for play in the chain 55 and to ensure that this chain 55 is pre-tensioned, thereby avoiding any abrupt acceleration at the instant of change of direction of the resisting moment, due to the load on the platform 3 (that is in a condition in which the swing arms 32*a*, 32*b* are vertical).

In a preferred embodiment of the invention, the rod-side chambers of the upper cylinders 51 and lower cylinders 52 can be in communication with a compensation chamber 80, with a manually controlled piston (by means of a nut and a screw, for example) for compressing the oil inside the rod-side chambers of the cylinders 51 and 52 so as to enable any slack in the chain 55 to be taken up by a simple manual operation, without it being necessary to connect a control unit.

When the fluid supply is interrupted, the platform 3 is stopped at the required height and is kept there by the non-return valves 59*a*, 59*b* which prevent the fluid from flowing out of the upper cylinders 51, thereby maintaining tension on the chain 55. In order to return the platform 3 to its closed position, the cylinders 51, 52 are operated in reverse order.

The alignment unit 60 makes it possible to keep the steps 35 and the platform 3 in a constant horizontal position all the time while the swing arms 32*a*, 32*b* are moving, thanks to the alignment chain 68 secured to the fixed pulley 65*a*, which keeps the pulleys 65 and 67 aligned thereto.

Figure 9:
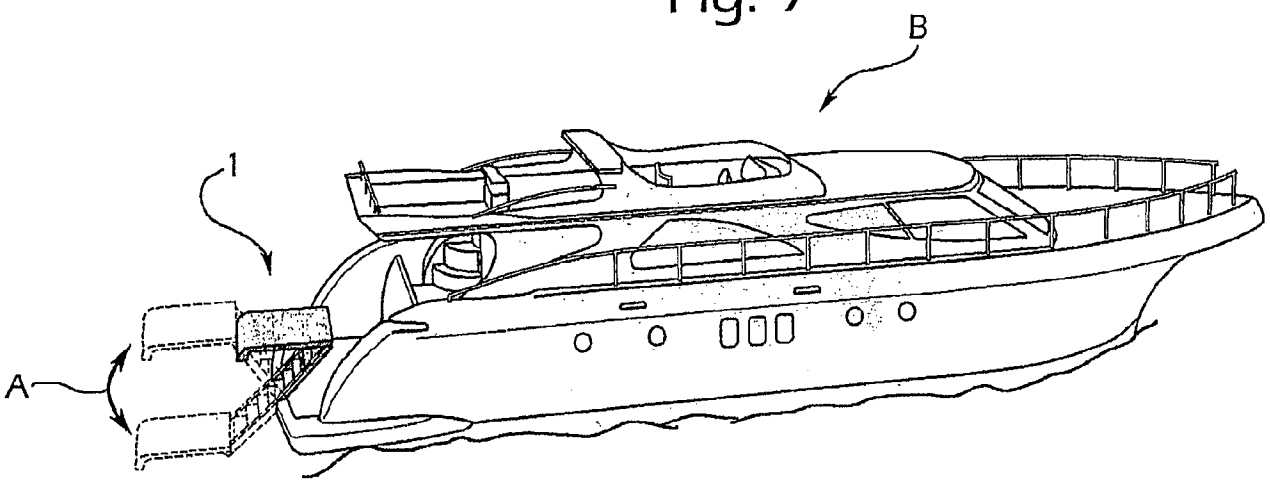
FIG. 9 is a view of a vessel fitted with a platform unit of the invention.

It can easily be seen that by lowering the platform 3 so that the swing arms 32*a*, 32*b* are in their fully open position (as shown in FIG. 9), it is possible to lower the platform 3 beneath the surface of the water, making it possible to launch or haul back on board a tender or similar craft associated with the boat B, while the steps 35 give swimmers easy access to the water. It is also possible to vary the position of the platform 3, so as to access quays of different heights, while the fact that the platform 3 and the steps 35 always remain horizontal makes it easy to board or disembark from the boat B. In addition, the fact that the platform 3 always remains horizontal while it is being moved, gives easy access to people who are in any way disabled and also makes it easy to load heavy objects.

The invention claimed is:

1. A movable platform unit (1) for a boat (B), which includes a base portion (2), secured to the boat (B), and at least one swing arm (32*a*, 32*b*) pivoted by one end to said base portion (2) and by the other to a loading platform (3), said at least one swing arm (32*a*, 32*b*) being rotatable by a first drive member (57) secured thereto and rotatable about the pivoting axis (x) of the swing arm (32*a*, 32*b*) onto the base portion (2), alignment means (67, 68) being provided for connecting said platform (3) with a second drive member (65*a*) fixed to said base portion (2) and coaxial with the pivoting axis (x) of the swing arm (32*a*, 32*b*) on the base portion (2), in such a way that the platform (3) is enabled to remain at a constant inclination to said base portion (2) during rotation of said at least one swing arm (32*a*, 32*b*), characterized in that said first drive member (57) includes a pulley element securely fixed to said at least one swing arm (32*a*, 32*b*) and operable to be rotated by first chain drive means (55), said chain drive means (55) and said pulley element (57) being enclosed within at least one hollow fixed arm (22*a*, 22*b*) provided in a cavity (21) of the base portion (2), and said at least one swing arm (32*a*, 32*b*) being pivoted to the distal end of said at least one fixed arm (22*a*, 22*b*) in such a way that the swing arm (32*a*, 32*b*) can assume a closed position, in which it lies flat in the cavity (21) of the base portion (2).

2. A platform unit according to claim 1, in which said second drive member (65*a*) includes a pulley element secured to said base portion (2), and said platform (3) is secured to a further pulley element (67), said second transmission member (65*a*) and said pulley element (67) being connected by second chain drive means (68) so as to be rotatable together in relation to the swing arm (32*a*, 32*b*).

3. A platform unit according to claim 1, in which said at least one swing arm (32*a*, 32*b*) has a plurality of step elements (35, 35*a*) mounted along its length for facilitating access to the platform (3) by users.

4. A platform unit according to claim 3, in which said alignment means (67, 68) connect said load platform (3) and said second drive member (65*a*) to third drive means (65), secured to said plurality of step elements (35, 35*a*) and rotatable about axes parallel to the axis (x) about which the swing arm (32*a*, 32*b*) is pivoted on the base portion (2) in such a way as to enable said plurality of step elements (35, 35*a*) constantly to maintain substantially the same inclination as said platform (3) during rotation of said at least one swing arm (32, 32*a*).

5. A platform unit according to claim 4, in which said third drive means (65) include a plurality of pulley elements, each secured to a respective step element (35), said second chain drive means (68) also connecting the pulley elements (65) of the step elements (35) to the pulley element of the second drive member (65*a*) in such a way that these pulley elements are rotatable together relative to the swing arm (32*a*, 32*b*).

6. A platform unit according to claim 1, in which said base portion (2) is adapted to be fixed to the structure of a boat (B).

7. A platform unit according to claim 1, in which said first chain drive means (55) is capable of being driven alternately by first and second hydraulic-cylinder control means (51, 52), operable to be controlled selectively by solenoid valve means (59).

* * * * *